US011336050B2

(12) United States Patent
James et al.

(10) Patent No.: US 11,336,050 B2
(45) Date of Patent: May 17, 2022

(54) PRESSURE ISOLATION ACROSS A CONDUCTOR

(71) Applicant: HALLIBURTON ENERGY SERVICES, INC., Houston, TX (US)

(72) Inventors: Paul Gregory James, Spring, TX (US); Ravi Sharad Vayeda, Spring, TX (US); Sean Michael Gum, Kingwood, TX (US); Glen Paul Breerwood, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/905,732

(22) Filed: Jun. 18, 2020

(65) Prior Publication Data

US 2021/0399464 A1 Dec. 23, 2021

(51) Int. Cl.

| | |
|---|---|
| ***H01R 13/52*** | (2006.01) |
| ***E21B 47/017*** | (2012.01) |
| ***E21B 17/02*** | (2006.01) |
| ***E21B 47/001*** | (2012.01) |
| ***H01R 13/504*** | (2006.01) |

(52) U.S. Cl.

CPC ..... *H01R 13/5205* (2013.01); *E21B 17/0285* (2020.05); *E21B 47/001* (2020.05); *E21B 47/017* (2020.05); *H01R 13/504* (2013.01); *H01R 13/5216* (2013.01)

(58) Field of Classification Search

CPC ..... H01R 13/5205; H01R 13/5216; H01R 13/504; E21B 47/017; E21B 47/001; E21B 17/0285

USPC ..... 340/853.2

See application file for complete search history.

(56) References Cited

U.S. PATENT DOCUMENTS

| | | | |
|---|---|---|---|
| 6,354,734 | B1 | 3/2002 | Curran et al. |
| 6,752,397 | B2 | 6/2004 | Kohli et al. |

(Continued)

FOREIGN PATENT DOCUMENTS

| | | | |
|---|---|---|---|
| EP | 1686363 | A1 | 8/2006 |
| WO | WO-2007083881 | A1 | 7/2007 |

OTHER PUBLICATIONS

Korean Intellectual Property Office, International Search Report and Written Opinion, PCT/US2020/038544, dated Mar. 5, 2021, 11 pages, Korea.

*Primary Examiner* — Taras P Bemko
*Assistant Examiner* — Yanick A Akaragwe
(74) *Attorney, Agent, or Firm* — Haynes and Boone, LLP

(57) ABSTRACT

A sensor apparatus for wellbore applications includes an electrical conductor extending within an armored tubular jacket to protect the electrical conductor. The electrical conductor is isolated from wellbore fluids when the sensor is placed in a wellhead flange by redundant seals such that the tubular jacket around the conductor does not provide a leak path to the surrounding subsea or surface environment. To isolate the electrical conductor, a connector housing may be provided that establishes a glass-metal seal or a PEEK-metal seal with the electrical conductor. The connector housing may be welded or otherwise sealed to a Christmas tree flange that connects to the wellhead flange. The welds and seals of the sensor apparatus may be proof tested to ensure their effectiveness before the Christmas tree flange is installed in the subsea or surface environment.

20 Claims, 6 Drawing Sheets

(56) References Cited

U.S. PATENT DOCUMENTS

| | | | | |
|---|---|---|---|---|
| 2002/0148306 | A1* | 10/2002 | Garel | E21B 25/00 73/864.43 |
| 2013/0027215 | A1* | 1/2013 | Kleppa | E21B 34/02 340/853.2 |
| 2013/0183853 | A1* | 7/2013 | Sivik | E21B 33/0385 439/519 |
| 2013/0277067 | A1* | 10/2013 | Emerson | E21B 17/028 166/378 |
| 2014/0216757 | A1 | 8/2014 | Kleppa | |
| 2016/0115395 | A1* | 4/2016 | Rustad | G05B 15/02 700/282 |
| 2016/0369622 | A1* | 12/2016 | Wheeler | E21B 47/12 |
| 2018/0179854 | A1 | 6/2018 | Healy | |
| 2020/0217148 | A1* | 7/2020 | Massey | E21B 17/06 |
| 2020/0249137 | A1* | 8/2020 | Simpson | G01M 3/36 |

* cited by examiner

PRESSURE ISOLATION ACROSS A CONDUCTOR

BACKGROUND

The present disclosure relates generally to hydrocarbon production, and more specifically to electrical conductors that operate in the associated high-pressure environments. Example embodiments described herein include electrical conductors used in connection with sensors that monitor the condition of hydrocarbons in a wellhead.

Subsea wellbores completed for hydrocarbon production may terminate at a wellhead located on the sea floor. The wellhead provides a structure from which downhole equipment such as production tubing may be supported and may also facilitate installation of a Christmas tree above the wellbore. A Christmas tree is generally a set of valves assembled into a unitary structure for controlling the flow of hydrocarbons from the wellbore. The valves may be operated, at least in part, in response to information provided by various sensors positioned to monitor conditions in the wellbore, within the Christmas tree, or other within other components of a wellbore system. For example, a sensor may be positioned within a wellbore flange to provide an indication of the condition of fluids exiting the wellbore.

Information regarding the condition of the fluid may be transmitted to a processor through a control line containing electrical conductor. The control line may extend to a location remote from wellhead and may thus provide a leak path through which high pressure hydrocarbons may escape into the environment.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure relates generally to a sensor or other electrical device that relies on an electrical current, e.g., for power or signal transmission, used in a high-pressure environment for wellbore applications. The systems and methods described herein may be employed in any type of wellhead application, including land based, platform and subsea applications without departing from the scope of the disclosure. For simplicity, the subsea case is described herein as an example, acknowledging that what is described is equally applicable to any wellhead application. A control line conductor electrically coupled to the electrical device may be encapsulated within an armored tubular jacket to protect the control line conductor from the pressures and temperatures that it may experience in the extreme environment. When the electrical device is placed in a wellhead flange, the tubular layer around the electrical conductor must be effectively isolated from the relatively high pressures within the wellhead such that hydrocarbon fluids do not leak through the tubular layer into the subsea environment. To isolate the tubular layer, a seal with an electrical conductor coupled between the electrical device and the control line conductor may be provided. For example, a glass-metal seal or a PEEK-metal seal may be established directly between the electrical conductor and Christmas tree flange, or a seal may be provided between the electrical conductor and a connector housing, and the connector housing may be welded to a Christmas tree flange. Various housing structures may be provided such as a bulkhead connector housing, an olive-shaped housing and/or a tubular shaped housing, and various types of seals and welds may be established to provide the pressure isolation. The welds and seals may be proof tested to ensure their effectiveness before the Christmas tree flange is installed to a wellhead flange in the subsea environment.

Figure 1:
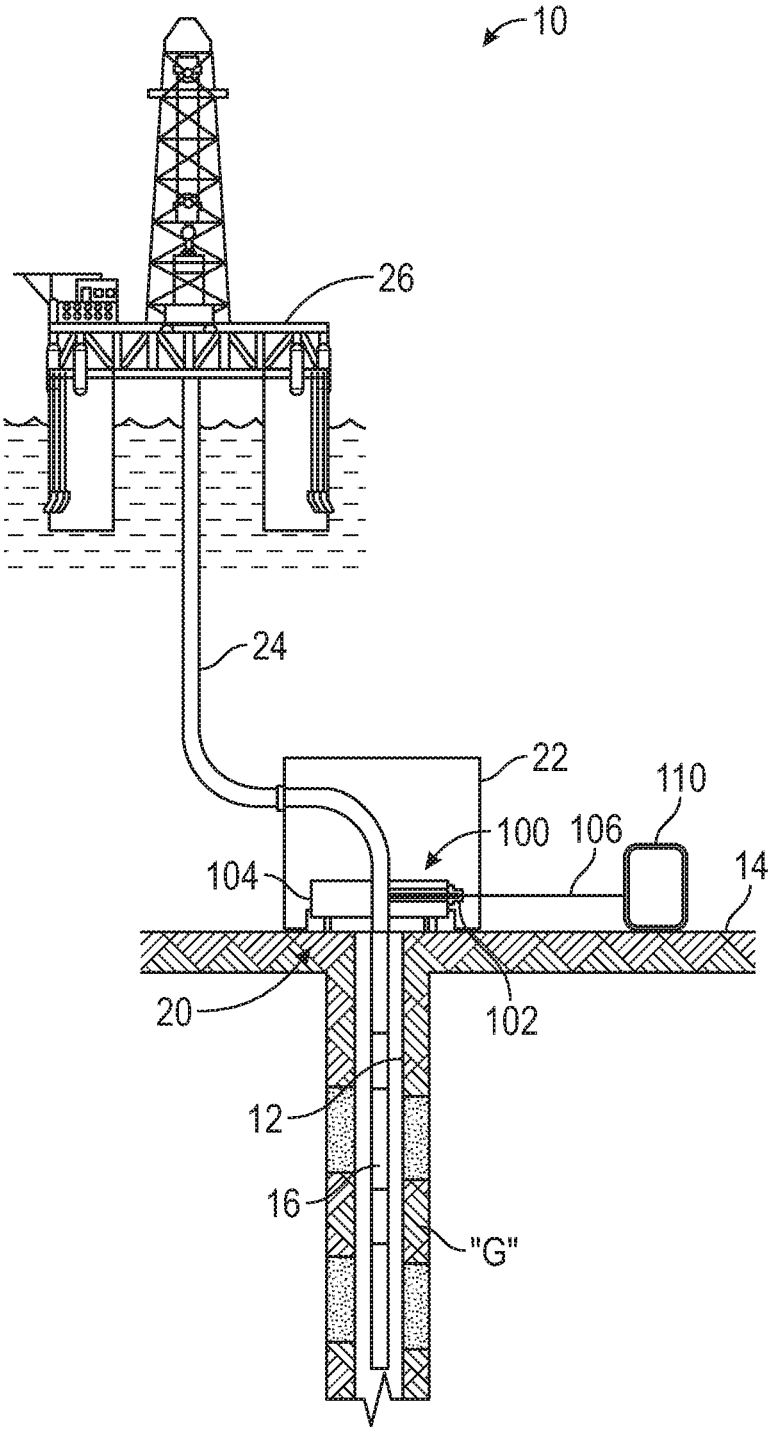
FIG. 1 is a partial, cross-sectional side view of a subsea wellbore system including a Christmas tree sensor apparatus having a sensor and an electrical pathway that extends from the sensor through the subsea environment in accordance with aspects of the present disclosure.

Referring initially to FIG. 1, a wellbore system 10 includes a wellbore 12 extending below the sea floor 14. The wellbore 12 may be completed with production tubing 16, which may receive hydrocarbons or other wellbore fluids from the surrounding geologic formation "G." The wellbore fluids may pass out of the wellbore 12 through the production tubing 16, which extends to a wellhead 20 on the sea floor 14. The wellhead 20 is generally a flanged structure that may support a casing string (not shown) and other downhole equipment in the wellbore 12. A Christmas tree 22 is mounted on the wellhead 20. The Christmas tree 22 may generally include an assembly of chokes, valves and spools to control the flow of wellbore fluids produced from the wellbore 12. A flow line 24 extends from the Christmas tree 22 to a floating platform 26, which may include facilities for extracting, storing and processing the wellbore fluids. In other embodiments, the floating platform 26 may be replaced by a barge or a platform fixed to the sea bed without departing from the scope of the disclosure.

A Christmas tree sensor assembly 100 is provided at the wellhead 20 to monitor a condition of the wellbore fluids exiting the wellbore 12. The Christmas tree sensor assembly 100 includes a Christmas tree flange 102 that couples to a wellhead flange 104. A tubing encapsulated conductor (TEC) or other control line 106 including an electrical conductor extends from the Christmas tree flange 102 to a junction box 110 on the sea floor 14. In other embodiments, the control line 106 may extend to the floating platform 26 or another location where information provided by the Christmas tree sensor system 100 may be evaluated. The Christmas tree sensor system 100 effectively isolates the control line 106 from the wellbore fluids passing through the wellhead, such that the wellbore fluids do not escape into the subsea environment along the control line 106.

Figure 2A:
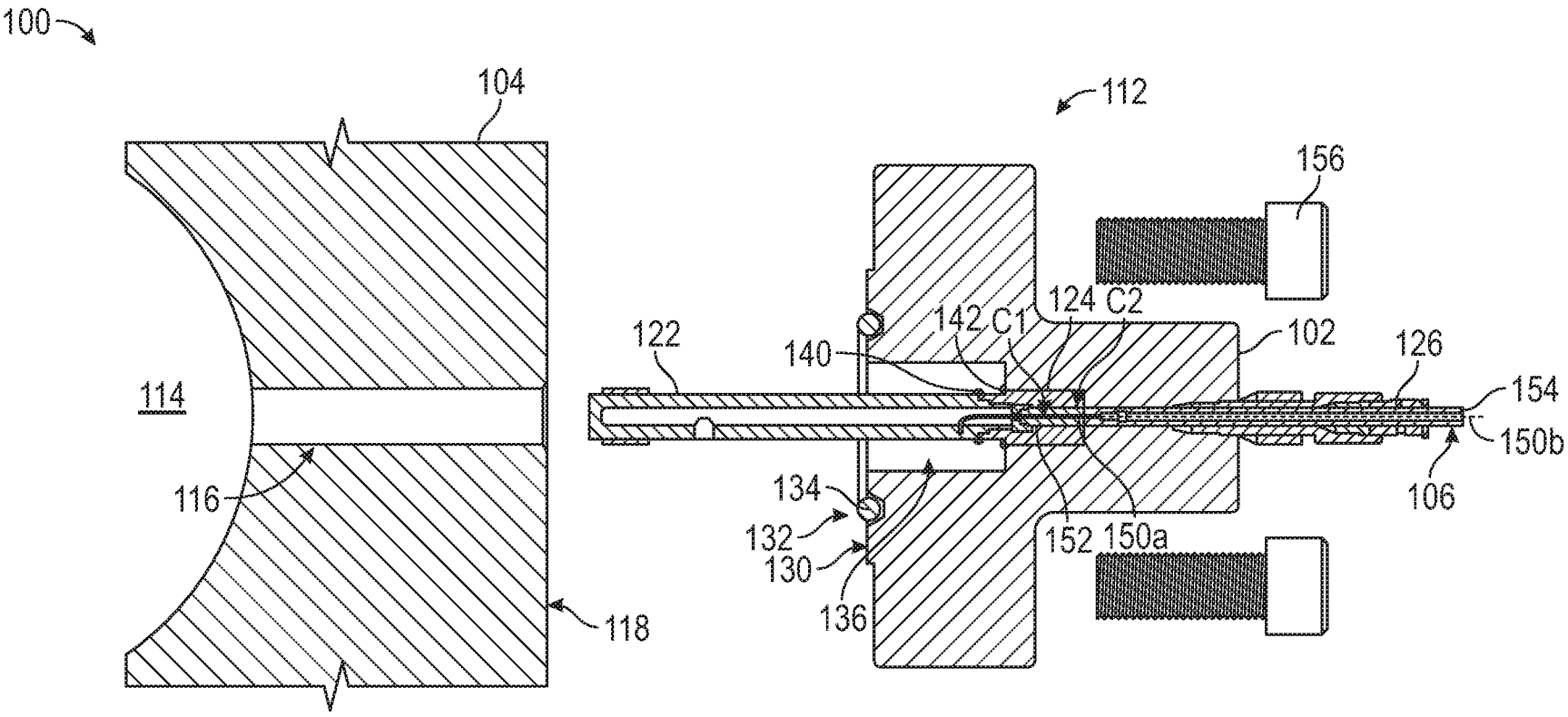
FIG. 2A is a partial, cross-sectional top view with parts separated of the sensor apparatus of FIG. 1 illustrating the sensor installed in a Christmas tree flange and an electrical conductor sealed to a connector housing that is welded to the Christmas tree flange.

Referring to FIG. 2A, the Christmas tree sensor system 100 is illustrated with parts separated. Specifically, a sensor apparatus 112 is illustrated separated from the wellhead flange 104. The wellhead flange 104 includes a flow passageway 114 extending therethrough in fluid communication with the production tubing 16 (FIG. 1). The flow passageway 114 permits passage of wellbore fluids between the production tubing 16 and the Christmas tree 22. A sensor receptacle 116 extends between the flow passageway and an exterior wall 118 of the wellhead flange 104.

The sensor apparatus 112 includes the Christmas tree flange 102, a sensor 122, a connector housing 124, a control line connector 126 and the control line 106. The sensor apparatus 112 may be assembled and proof tested before installation to the wellhead flange 104 to ensure fluids will not leak into the control line 106 in operation. The Christmas tree flange 102 includes a mating surface 130 for engaging the exterior wall 118 of the wellhead flange 104. A seal groove 132 may be defined in the mating surface 130 to receive an o-ring 134 or other compressible sealing member. A cavity 136 extends from the mating surface 130 into an interior of the Christmas tree flange 102. The cavity 136 is circumscribed by the seal groove 132 such that the cavity 136 may be fluidly isolated from an exterior of the Christmas tree flange 102 by the o-ring 134 when the mating surface 130 of the Christmas tree flange 102 is engaged with the exterior wall 118 of the wellbore flange 104 (see, e.g., FIG. 2B).

The sensor 122 protrudes from the cavity 136 of the Christmas tree flange 102. The sensor 122 may include a temperature sensor, a pressure gauge or another type of electrical device. The sensor 122 is coupled to the connector housing 124 by a first circumferential weld 140 and the connector housing 124 is coupled to the Christmas tree flange 102 by a second circumferential weld 142 formed between an exterior surface of the connector housing 124 and an interior surface of the Christmas tree flange within the cavity 136. The first and second circumferential welds 140, 142 may be generated by laser welding, electron beam welding, autogenous welding or a similar welding process. The first and second circumferential welds 140, 142 may extend continuously around an entire circumference of the sensor 122 and connector housing 124 to prevent ingress of fluids into the intersection between the sensor 122 and connector housing 124, and into the intersection between the connector housing 124 and Christmas tree flange 102.

An electrical conductor 150*a* passes through the connector housing 124 to provide electrical communication between the sensor 122 and a control line conductor 150*b* extending through the control line 106. The connector housing 124 may be constructed of a metallic material such as a nickel-chromium alloy containing iron, columbium, and molybdenum, along with lesser amounts of aluminum and titanium. These component metals may be provided in proportions such that the properties of the connector housing 124, like the coefficient of thermal expansion or other properties of an insulating material 152 circumscribing the electrical conductor 150*a*, are compatible. The insulating material 152 fills a circumferential annulus defined between the electrical conductor 150*a* and the connector housing 124 and thereby provides a circumferential seal between an exterior circumferential surface C1 of the electrical conductor 150*a* and an interior surface of the connector housing 124. Since the connector housing 124 is sealed to the Christmas tree flange 102 by circumferential weld 142, an outer circumferential seal is defined about an exterior circumference C2 of the insulating material 152 between the insulating material 152 and the Christmas tree flange 102 through the connector housing 124. In some embodiments, the insulating material 152 may include glass or a PEEK material, and in some embodiments the connector housing 124 may be Inconel® Alloys 718 or X-750, which may approximate the coefficient of thermal expansion of the glass or PEEK material.

The control line 106 is coupled to the Christmas tree flange 102 with the control line connector 126. The control line connector 126 may provide redundant metal-metal seals between the Christmas tree flange 102 and a jacket 154 circumscribing the control line conductor 150*b* of the control line 106.

The sensor apparatus 112 may be proof tested before installation to the wellhead flange 104. Since the circumferential weld 142 defined between the connector housing 124 may be relatively small, e.g., ¾ inch in diameter, volumetric inspection procedures may be difficult to carry out. The integrity of the weld 142 and the seal formed by the insulating material 152 may be verified with pressure tests in a laboratory, e.g., before being deployed into the subsea environment. For example, a test pressure may be applied on first side of the Christmas tree flange 102 in the laboratory, and the test pressure may be monitored to verify that there are no leaks through the sensor apparatus. The sensor apparatus 112 may then be coupled to the wellhead flange 104 with fasteners 156.

Figure 2B:
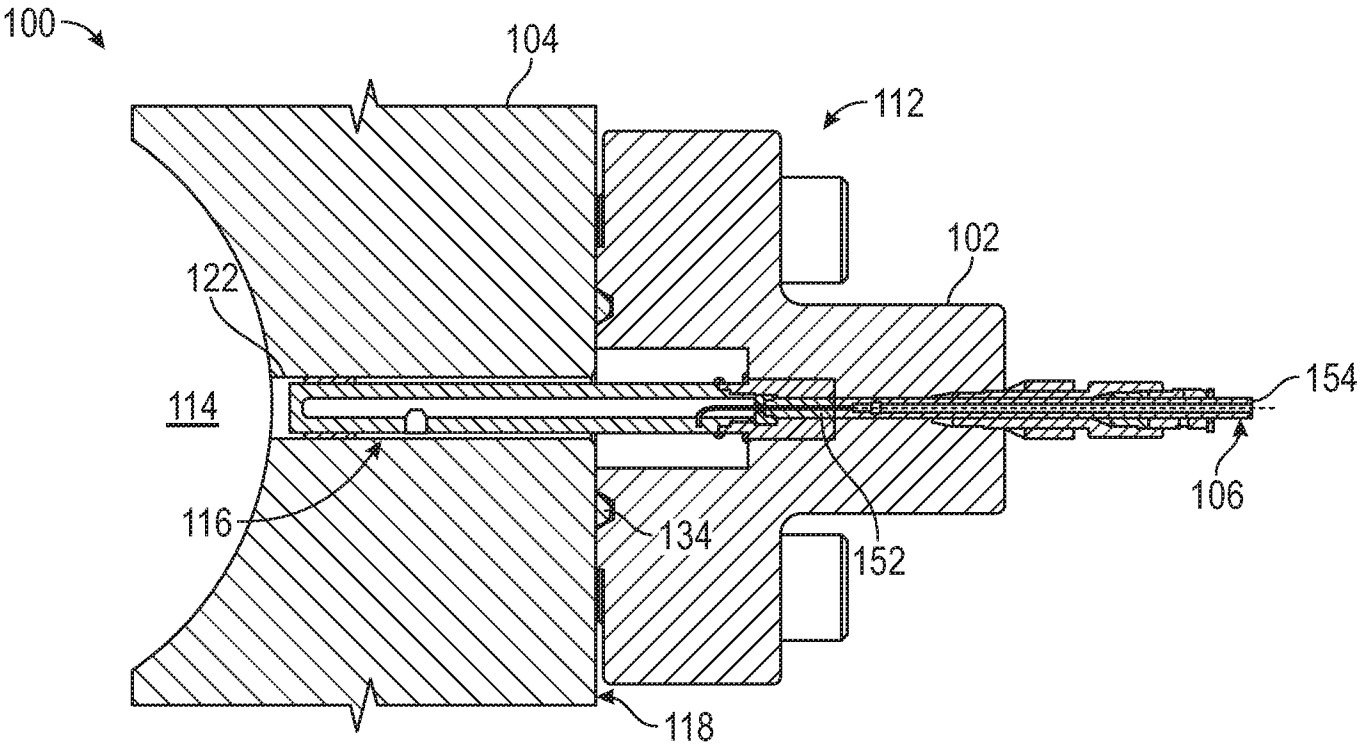
FIG. 2B is a partial, cross sectional top view of the sensor apparatus of FIG. 2A in an assembled configuration with the Christmas tree flange coupled to a wellhead flange.

Referring to FIG. 2B, the Christmas tree sensor system 100 is illustrated with the sensor apparatus 112 coupled to the wellhead flange 104. The fasteners 156 compress the o-ring 134 against the exterior wall 118 of the wellhead flange 104 to form a seal between the Christmas tree flange 102 and the wellhead flange 104. The o-ring 134 circumscribes the receptacle 116 such that any wellbore fluids passing through the receptacle will not leak into the surrounding environment between the wellbore flange 104 and the Christmas tree flange 102. The sensor 122 extends into the sensor receptacle 116 such that the sensor 122 may be placed in proximity with the flow passageway 114. For any wellbore fluids to escape from the flow passageway 114 through the jacket 154 of the control line 106, at least two seals must be breached. For example, if a barrel of the sensor 122 is breached, and wellbore fluids enter an interior of the sensor 122, the second seal provided by the insulating material 152 would also need to be breached before the wellbore fluids could flow into the jacket 154. The sensor apparatus 112 thus provides redundant seals to protect the subsea environment.

Figure 3:
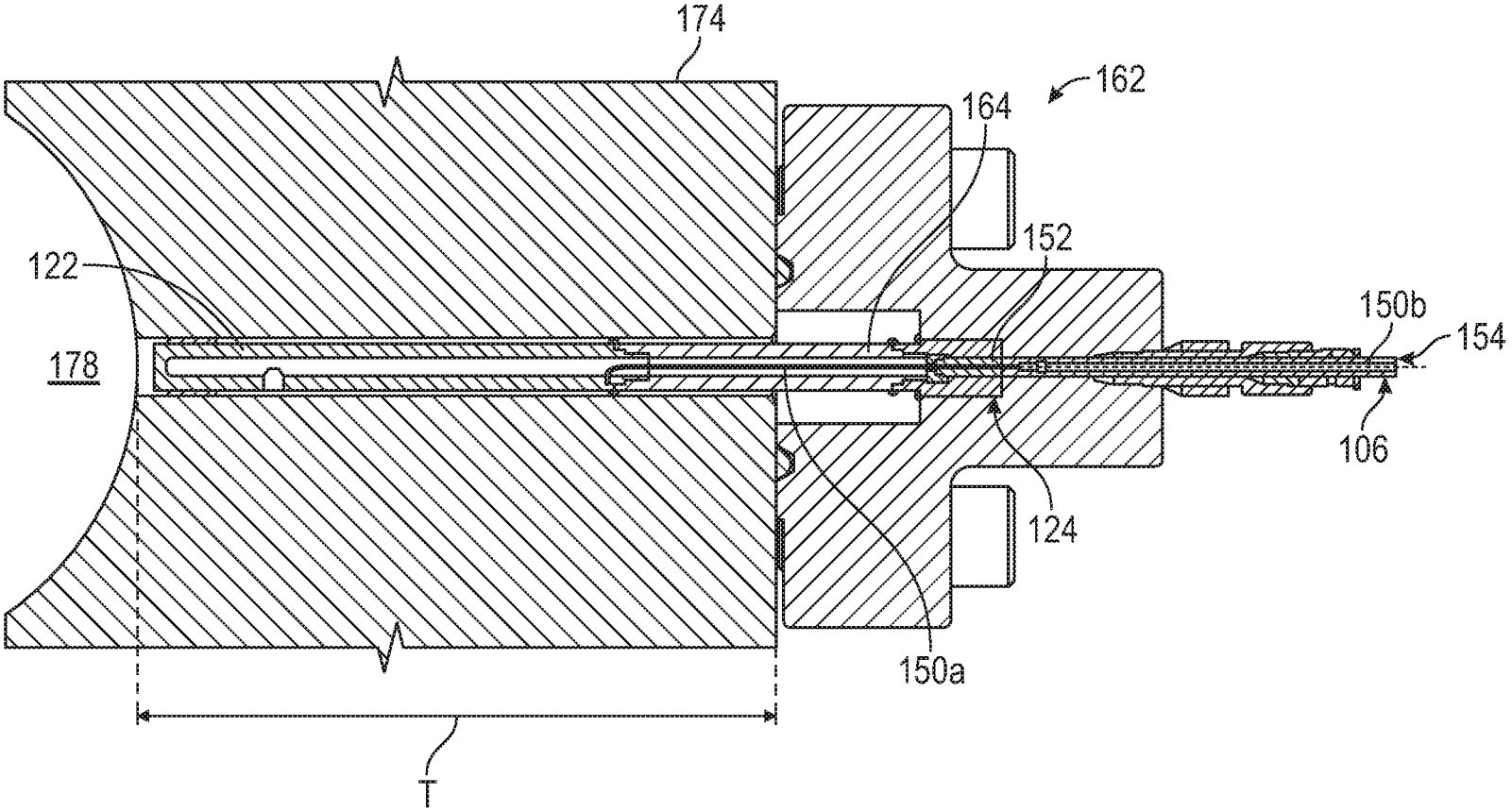
FIG. 3 is a partial, cross-sectional top view of an alternate sensor apparatus illustrating an extension member to accommodate a wellbore flange having an extended thickness.

Referring to FIG. 3, an alternate embodiment of a sensor apparatus 162 is illustrated with an extension member 164 to accommodate a wellbore flange 174 having an extended thickness "T." The extension member 164 may be welded to the sensor 122 and to the connector housing 124 by circumferential welds such that the sensor 122 protrudes from the Christmas tree flange 102 a sufficient distance to maintain the sensor 122 in proximity with the flow passageway 178 extending through the wellbore flange 174 when the Christmas tree flange 102 is engaged with an exterior wall of the wellbore flange 174. The electrical conductor 150*a* may extend through the insulating material 152, which forms a seal between the connector housing 124 and the electrical conductor 150*a* as described above. As illustrated, the electrical conductor 150*a* extends further thorough the extension member 164 to communicate with the sensor 122.

In other embodiments, separable electrical connections (not shown) may be established between the sensor 122 and the connector housing 124. For any wellbore fluids to escape from the flow passageway 178 to an interior of the jacket 154 of the control line 106, a seal through the extension member 164 or the sensor 122 must be breached as well as the seal formed by the insulating material 152.

Figure 4:
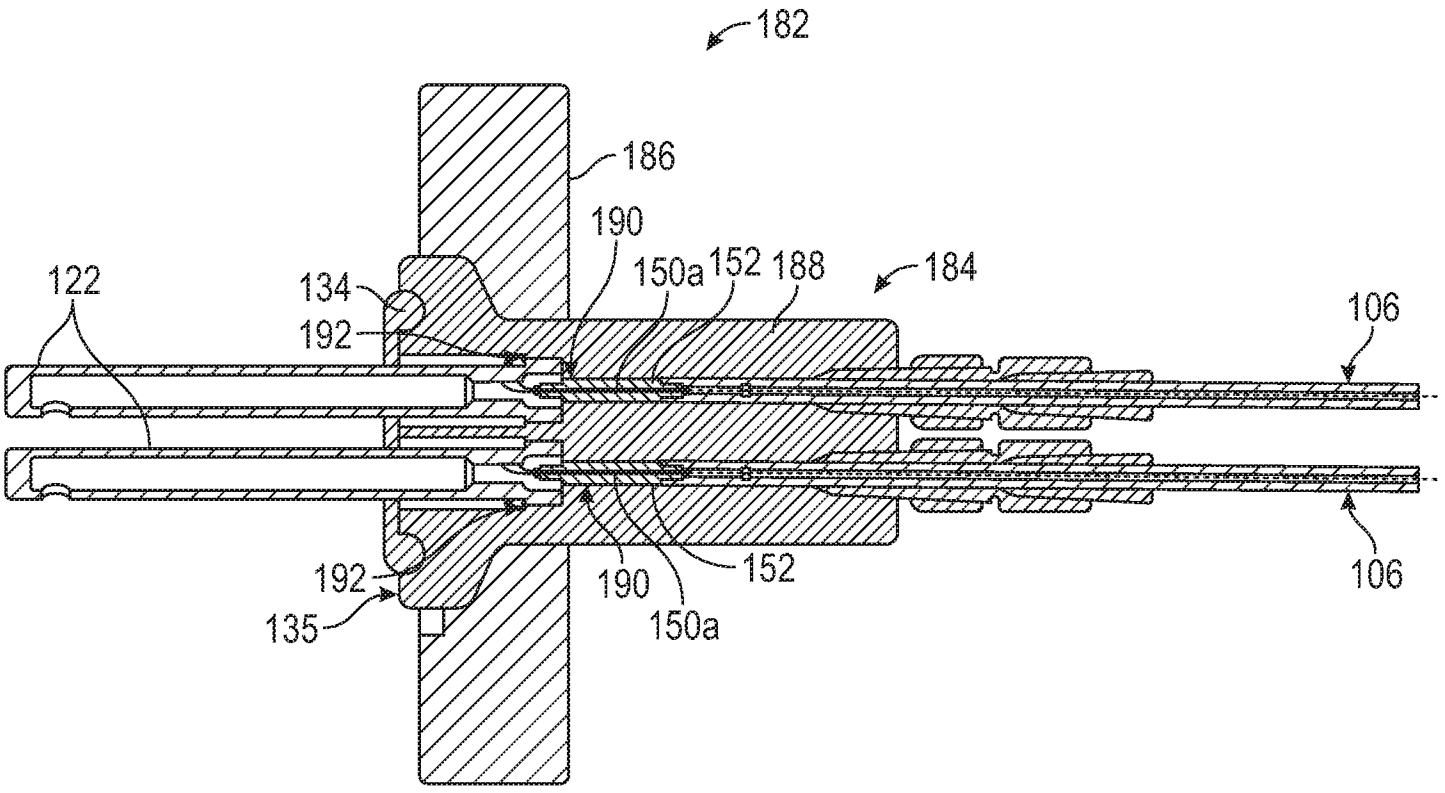
FIG. 4 is a partial, cross-sectional top view of an alternate sensor apparatus illustrating a pair of sensors carried by a single Christmas tree flange and electrical conductors extending from each of the sensors and sealed directly inside a single Christmas tree flange.

Referring to FIG. 4, an alternate sensor apparatus 182 includes a pair of sensors 122 carried by a single Christmas tree flange 184. The Christmas tree flange 184 includes a swivel ring 186 and a swivel hub 188. The swivel ring 186 may fastened to an exterior wall of a wellbore flange 104 (FIG. 2A) to compress o-ring 134 or other sealing element carried on a mating surface 135 of the swivel hub 188 circumscribing the sensors 122. The o-ring 134 forms a seal between the wellbore flange 104 and the swivel hub 188 around the sensors 122.

A pair of bulkhead connectors 190 are housed inside the swivel hub 188. The bulkhead connectors 190 each include electrical conductor 150*a* extending therethrough. The electrical conductor 150*a* may be constructed of a wire or a generally rigid rod or pin. A seal may also be established with the electrical conductor 150*a* extending through the bulkhead connectors 190. Specifically, insulating material 152 may form a circumferential seal between the electrical conductor 150*a* and the swivel hub 188 to form a barrier along the electrical conductor 150*a*. An outer circumferential seal is formed directly between the insulating material 152 and the Christmas tree flange 184 through the swivel hub 188 (e.g., without a connector housing 124 (FIG. 2A) described above). In some embodiments, the insulating material 152 may include glass or a PEEK material, and in some embodiments the swivel hub 188 may be constructed of Inconel® Alloys 718 or X-750, which may approximate the coefficient of thermal expansion of the glass or PEEK material.

Each of the control lines 106 are redundantly protected from penetration by wellbore fluids when the sensor apparatus 182 is coupled to a wellhead flange (see wellhead flange 104 illustrated in FIG. 1). The sensors 122 are welded to the swivel hub 188 by circumferential welds 192. The circumferential welds 192 may be completed by e-beam welding or a similar process as described above to seal the sensors 122 to the swivel hub 188. The circumferential welds 192 and the insulating material 152 provide redundant protection against the ingress of wellbore fluids into the control lines 106.

Figure 5:
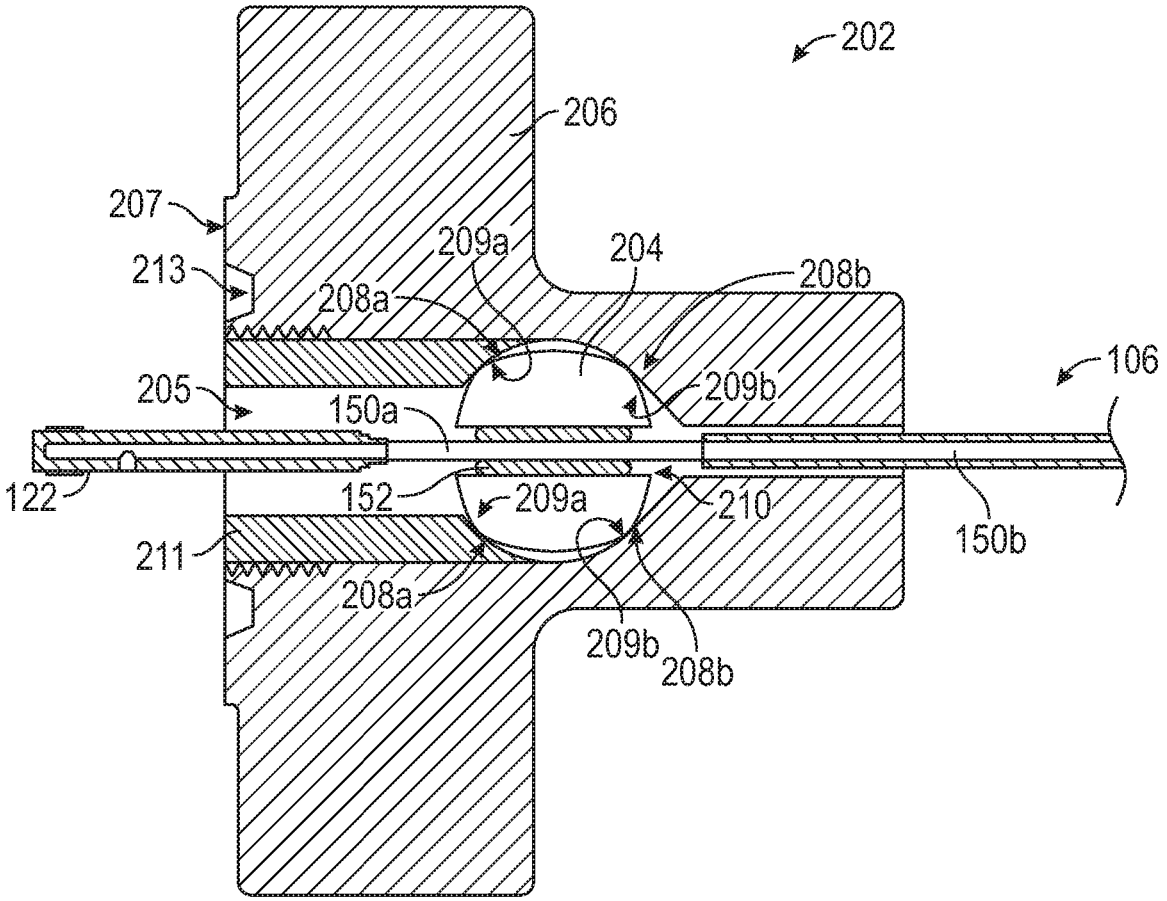
FIG. 5 is a partial, cross-sectional top view of an alternate sensor apparatus illustrating an olive-shaped connector housing within a Christmas tree flange and electrical conductor extending through a glass-metal seal formed with the olive-shaped housing.

Referring to FIG. 5, an alternate sensor apparatus 202 includes an olive-shaped connector housing 204 within a longitudinal opening 205 in a Christmas tree flange 206. The longitudinal opening 205 extends from a mating surface 207 of the Christmas tree flange 206. A seal groove 213 circumscribes the longitudinal opening 205 such that an o-ring 134 (FIG. 2A) or other seal member may be carried by the Christmas tree flange 206 to form a seal around sensor 122 protruding from the longitudinal opening 205.

The Olive-shaped connector housing 204 exhibits an oval or oblong cross section with curved corners 208*a*, 208*b*. The curved corners 208*a* engage corresponding interior surfaces 209*a* of the Christmas tree flange 206 and form a metal-to-metal seal therewith. The curved corners 208*b* engage corresponding interior surfaces 209*b* of a retainer 211 and form a metal-to-metal seal therewith. The retainer 211 may be threaded into a longitudinal opening 210 defined in the Christmas tree flange 206 such that the olive-shaped connector housing 204 is compressed between the Christmas tree flange 206 and the retainer 211. The compression of the olive-shaped housing 204 facilitates the formation of the metal-to-metal seals at the corners 208*a*, 208*b* of the olive-shaped connector housing 204. The control line conductor 150*b* of the control line 106 is coupled to the electrical conductor 150*a* extending through a longitudinal opening 210 in the olive-shaped connector housing 204 to communicate with the sensor 122. The insulating material 152 circumscribes the electrical conductor 150*a* and fills an annular gap therebetween to form a seal between the electrical conductor 150*a* and the olive-shaped connector housing 204. Thus, an exterior of the olive-shaped connector housing 204 forms a seal with the Christmas tree flange 206 and an interior of the olive-shaped connector housing 204 forms a seal with the insulating material 152 and the electrical conductor 150*a*. Although not illustrated explicitly in FIG. 5, a control line connector 126 (FIG. 2A) may be provided on the Christmas tree Flange 206, as described above.

Figure 6:
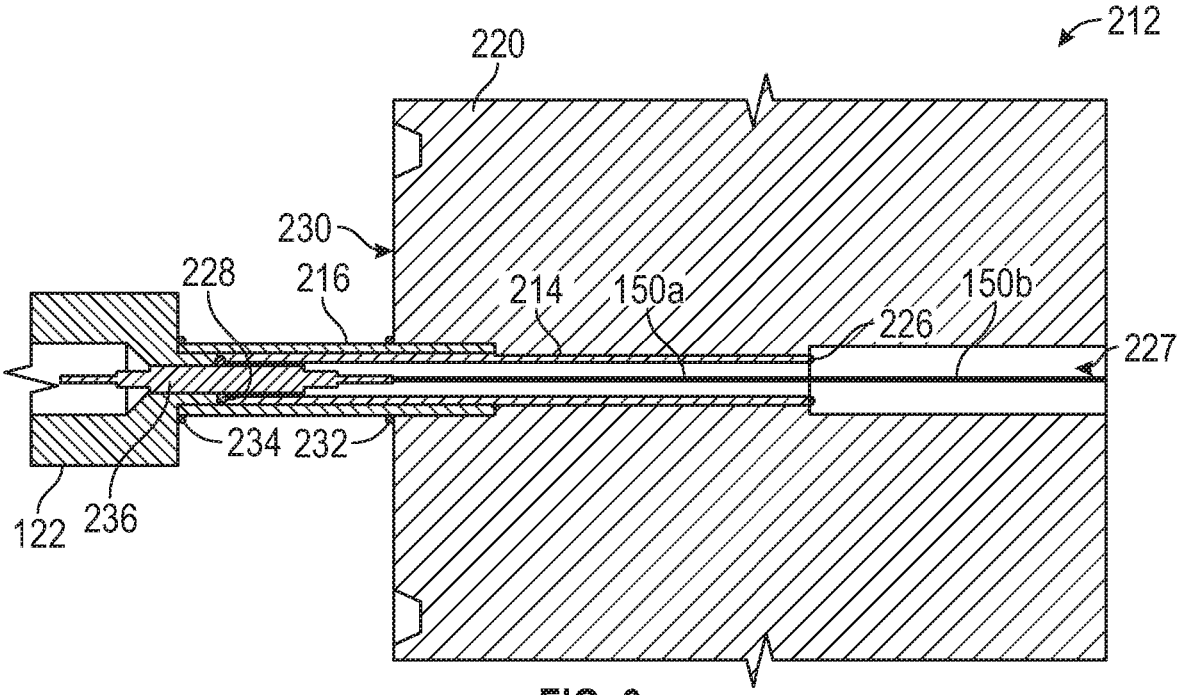
FIG. 6 is a partial, cross-sectional top view of an alternate sensor apparatus illustrating an electrical conductor housed inside inner and outer tubular housings welded to a Christmas tree flange.

Referring to FIG. 6, an alternate sensor apparatus 212 includes an electrical conductor 150*a* extending inside inner and outer tubular housings 214, 216 welded to a Christmas tree flange 220. The outer tubular housing 216 circumscribes at least a portion of inner tubular housing 214. The inner tubular housing 214 extends longitudinally beyond the outer tubular housing 216 into an interior of the Christmas tree flange 220 where the inner tubular housing 214 may be welded to Christmas tree flange 220. A weld 226 may be formed on an exterior of the inner tubular housing 214 to join the inner tubular housing 214 to the Christmas tree flange 220. The weld 226 may be formed within a receptacle 227 formed in the Christmas tree flange 220. The receptacle 227 may receive a control line connector 126 (FIG. 2A) to couple a control line conductor 150*b* of a control line 106 (FIG. 2A) to the electrical conductor 150*a*.

A weld 228 may be formed on the exterior of the inner tubular housing 214 to join the inner tubular housing 214 to the sensor 122. The inner tubular housing 214 protrudes from an exterior mating surface 230 of the Christmas tree flange 220 such that the sensor 122 protrudes from the Christmas tree flange 220. A weld 232 may be formed on an exterior of the outer tubular housing 216 to join the outer tubular housing 216 to the Christmas tree flange 220, and a weld 234 may be formed on the exterior of the outer tubular housing 216 to join the outer tubular housing 216 to the sensor 122. A seal groove 229 defined in the mating surface 230 circumscribes the outer tubular housing 216 such that a seal may be formed with an exterior wall of a wellhead flange 104 (FIG. 2A) as described above.

If the outer tubular housing 216 is breached in operation, the electrical conductor 150*a* remains isolated from the ingress of wellbore fluids by the inner tubular housing 214 and the welds 226, 228. Since at least two welds protect the electrical conductor 150*a* from the ingress of wellbore fluids, the control line conductor 150*b* will not provide a leak path to the surrounding environment. The electrical conductor 150*a* may communicate with the sensor 122 through an electrical bulkhead 236 or generally rigid pin. In some embodiments, an insulating material 152 (FIG. 5) may be provided around the electrical conductor 150*a* and/or the electrical bulkhead 236 to form a seal between the inner tubular housing 214 and electrical conductor 150*a* and/or electrical bulkhead 236.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, a system for transmitting electrical current in a wellbore Christmas tree includes a wellhead at the upper end of a wellbore. The wellhead including, a flow passageway extending therethrough and a wellhead flange defining an exterior wall and a receptacle therein. A Christmas tree flange of the system has a mating surface engaged with the exterior wall of the wellhead flange, and a seal member circumscribing the receptacle of the wellhead and forming a seal between the exterior wall of the wellhead flange and the mating surface of the Christmas tree flange. The system also includes an electrical device protruding from the Christmas tree flange through the seal member and into the receptacle of the wellhead flange. An electrical conductor electrically coupled to the electrical device and extends into the Christmas tree flange. A control line extends from the Christmas tree flange and the control line includes a control line conductor electrically coupled to the electrical device through the electrical conductor. An insulating material circumscribes the electrical conductor and forms an inner circumferential seal with an exterior circumference of the electrical conductor and an outer circumferential seal about an exterior circumference of the insulating material is formed between the insulating material and the Christmas tree flange.

In one or more embodiments, the control line further includes a tubing encapsulated conductor having a jacket circumscribing the control line conductor, the tubing encapsulated conductor extending to a location remote from the Christmas tree. In some embodiments, the exterior circumference of the insulating material engages an interior surface of the Christmas tree flange such that the outer circumferential seal is formed directly between the insulating material and the Christmas tree flange.

In some embodiments, the exterior circumference of the insulating material engages an interior surface of a connector housing, and an exterior of the connector housing engages an interior surface of the Christmas tree flange such that the outer circumferential seal is formed through the connector housing. In some embodiments, the exterior of the connector housing is welded in an interior cavity of the Christmas tree flange, wherein the interior cavity is fluidly isolated from an exterior of the Christmas tree flange by engagement of the mating surface of the Christmas tree flange to the exterior wall of the wellhead flange.

In some embodiments, the insulating material includes at least one of the group consisting of glass and PEEK material filling a circumferential annulus defined between the electrical conductor and the connector housing. In some embodiments, the electrical device is a sensor operable to detect a condition or composition of fluid flowing through the flow passageway of the wellhead.

In another aspect, the disclosure is directed to an apparatus for transmitting electrical power or signals in a wellbore Christmas tree. The apparatus includes a Christmas tree flange having a mating surface for engaging a wellhead flange. An interior cavity extends into the Christmas tree flange from the mating surface and a seal groove on the mating surface circumscribes the interior cavity. An electrical device protrudes from the mating surface of the Christmas tree flange. An electrical conductor is electrically coupled to the electrical device and extends into the interior cavity of the Christmas tree flange. An insulating material circumscribing the electrical conductor forms an inner circumferential seal with an exterior circumference the electrical conductor. An outer circumferential seal about an exterior circumference of the insulating material forms a seal between the insulating material and the Christmas tree flange.

In one or more embodiments, the electrical device includes a sensor. In some embodiments, the apparatus further includes a control line connector coupled to the Christmas tree flange. The control line connector electrically couples the electrical conductor extending from the sensor or other electrical device to a control line conductor, and the control line connector is operable to form a seal between the Christmas tree flange and the control line conductor. The exterior circumference of the insulating material may engage an interior surface of a connector housing, and an exterior of the connector housing may engage an interior surface of the Christmas tree flange such that the outer circumferential seal is formed through the connector housing. In some embodiments, the sensor is one of a pair of sensors carried by the Christmas tree flange operable to detect a pressure or temperature of the fluid in proximity thereto.

In some embodiments, the apparatus further includes an extension member coupled between the electrical device and the connector housing. The extension member may be welded to the electrical device and to the connector housing by circumferential welds. In some embodiments, the electrical conductor comprises an electrical bulkhead extending into the connector housing. In some embodiments, the connector housing exhibits an olive shaped cross section with curved corners forming a metal-to-metal seal with the Christmas tree flange. The insulating material may fill a circumferential annulus defined between the electrical conductor and the connector housing.

In one or more embodiments, the connector housing comprises an inner tubular housing welded to the Christmas tree flange with an inner circumferential weld and an outer tubular housing circumscribing the inner tubular housing and welded to the Christmas tree with an outer circumferential weld. The inner and outer tubular housings may each be welded to the sensor or other electrical device.

In another aspect, the disclosure is directed to a method of isolating an electrical conductor extending from an electrical device in a Christmas tree. The method includes passing the electrical conductor into a longitudinal opening defined in a Christmas tree flange to define a circumferential annulus around the electrical conductor, filling the circumferential annulus with an insulating material to form a seal with an exterior of the electrical conductor, forming a circumferential seal between an exterior of the insulating material and a Christmas tree flange, coupling the electrical device to the Christmas tree flange and installing the Christmas tree flange on a wellbore flange such that the electrical device is proximate a flow passageway extending through the wellbore flange.

The method may further include, prior to installing the Christmas tree flange to the wellbore flange, proof testing the seals formed with the exterior of the electrical conductor, the interior of the connector housing and the exterior of the connector housing by applying a test pressure to one side of the Christmas tree flange. In some embodiments, filling the circumferential annulus with an insulating material includes filling the circumferential annulus with at least one of the group consisting of glass and PEEK material.

According to a another aspect, a sensor system for detecting a condition of wellbore fluids entering a subsea Christmas tree includes a wellhead at the upper end of a subsea wellbore, the wellhead including, a flow passageway extending therethrough and a wellhead flange defining an exterior wall and a sensor receptacle therein, a Christmas tree flange having a mating surface engaged with the exterior wall of the wellhead flange, a sensor protruding from the Christmas tree flange into the sensor receptacle, the sensor operable to detect a condition of a fluid flowing through the flow passageway of the wellhead, a control line extending from the Christmas tree flange, the control line including an electrical conductor electrically coupled to the sensor, a connector housing circumscribing the electrical conductor, an exterior of the connector housing forming a circumferential seal with the Christmas tree flange and an insulating material circumscribing the electrical conductor and forming a seal with the electrical conductor and an interior of the connector housing.

According to another aspect, a sensor apparatus for detecting a condition of wellbore fluids entering a subsea Christmas tree, the apparatus includes a Christmas tree flange having a mating surface for engaging a wellhead flange, a sensor protruding from the mating surface of the Christmas tree flange, the sensor operable to detect a condition of a fluid flowing in proximity thereto, an electrical conductor electrically coupled to the sensor and extending into the Christmas tree flange, a connector housing circumscribing the electrical conductor, an exterior of the connector housing forming a circumferential seal with the Christmas tree flange, and an insulating material circumscribing the electrical conductor and forming a seal with the electrical conductor and an interior of the connector housing.

According to another aspect, a method of isolating an electrical conductor extending from a sensor for detecting a condition of wellbore fluids entering a subsea Christmas tree includes passing the electrical conductor through a longitudinal opening defined in a connector housing to define a circumferential annulus between the electrical conductor and the connector housing, filling the circumferential annulus with an insulating material to form a seal with both an exterior of the electrical conductor and an interior of the connector housing, forming a circumferential seal between an exterior of the connector housing and a Christmas tree flange, coupling the sensor to the Christmas tree flange, and installing the Christmas tree flange on a wellbore flange in a subsea environment such that the sensor is proximate a flow passageway extending through the wellbore flange.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A system for transmitting electrical current in a wellbore Christmas tree, the system comprising:

a wellhead at the upper end of a wellbore, the wellhead including, a flow passageway extending therethrough and a wellhead flange defining an exterior wall and a receptacle therein;

a Christmas tree flange having a mating surface engaged with the exterior wall of the wellhead flange;

a seal member circumscribing the receptacle of the wellhead and forming a seal between the exterior wall of the wellhead flange and the mating surface of the Christmas tree flange;

an electrical device protruding from the Christmas tree flange through the seal member and into the receptacle of the wellhead flange;

an electrical conductor electrically coupled to the electrical device and extending into the Christmas tree flange;

a control line extending from the Christmas tree flange, the control line including a control line conductor electrically coupled to the electrical device through the electrical conductor; and an insulating material circumscribing the electrical conductor and forming an inner circumferential seal with an exterior circumference of the electrical conductor and an outer circumferential seal about an exterior circumference of the insulating material between the insulating material and the Christmas tree flange, wherein the exterior circumference of the insulating material engages an interior surface of a connector housing, and an exterior of the connector housing engages an interior surface of the Christmas tree flange such that the outer circumferential seal is formed through the connector housing; and an extension member coupled between the electrical device and the connector housing the extension member welded to the electrical device and to the connector housing by circumferential welds.

2. The system of claim 1, wherein the control line further comprises a tubing encapsulated conductor having a jacket circumscribing the control line conductor, the tubing encapsulated conductor extending to a location remote from the Christmas tree.

3. The system of claim 1, wherein the exterior of the connector housing is welded in an interior cavity of the Christmas tree flange, wherein the interior cavity is fluidly isolated from an exterior of the Christmas tree flange by engagement of the mating surface of the Christmas tree flange to the exterior wall of the wellhead flange.

4. The system of claim 1, wherein the insulating material includes at least one of the group consisting of glass and PEEK material filling a circumferential annulus defined between the electrical conductor and the connector housing.

5. The system of claim 1, where the electrical device is a sensor operable to detect a condition or composition of fluid flowing through the flow passageway of the wellhead.

6. An apparatus for transmitting electrical power or signals in a wellbore Christmas tree, the apparatus comprising:

a Christmas tree flange having a mating surface for engaging a wellhead flange, an interior cavity extending into the Christmas tree flange from the mating surface and a seal groove on the mating surface circumscribing the interior cavity;

an electrical device protruding from the mating surface of the Christmas tree flange;

an electrical conductor electrically coupled to the electrical device and extending into the interior cavity of the Christmas tree flange; and an insulating material circumscribing the electrical conductor and forming an inner circumferential seal with an exterior circumference the electrical conductor and an outer circumferential seal about an exterior circumference of the insulating material between the insulating material and the Christmas tree flange;

wherein the exterior circumference of the insulating material engages an interior surface of a connector housing, and an exterior of the connector housing engages an interior surface of the Christmas tree flange such that the outer circumferential seal is formed through the connector housing; and wherein the connector housing comprises an inner tubular housing welded to the Christmas tree flange with an inner circumferential weld and an outer tubular housing circumscribing the inner tubular housing and welded to the Christmas tree flange with an outer circumferential weld.

7. The apparatus of claim 6, further comprising a control line connector coupled to the Christmas tree flange, the control line connector electrically coupling the electrical conductor extending from the electrical device to a control line conductor, and the control line connector operable to form a seal between the Christmas tree flange and the control line conductor.

8. The apparatus of claim 6, further comprising an extension member coupled between the electrical device and the connector housing, the extension member welded to the electrical device and to the connector housing by circumferential welds.

9. The apparatus of claim 6, wherein the electrical conductor comprises an electrical bulkhead extending into the connector housing.

10. The apparatus of claim 6, wherein the inner and outer tubular housings are each welded to the electrical device.

11. The apparatus of claim 6, wherein the electrical device is one of a pair of sensors carried by the Christmas tree flange operable to detect a pressure or temperature of the fluid in proximity thereto.

12. An apparatus for transmitting electrical power or signals in a wellbore Christmas tree, the apparatus comprising:

a Christmas tree flange having a mating surface for engaging a wellhead flange, an interior cavity extending into the Christmas tree flange from the mating surface and a seal groove on the mating surface circumscribing the interior cavity;

an electrical device protruding from the mating surface of the Christmas tree flange;

an electrical conductor electrically coupled to the electrical device and extending into the interior cavity of the Christmas tree flange; and an insulating material circumscribing the electrical conductor and forming an inner circumferential seal with an exterior circumference the electrical conductor and an outer circumferential seal about an exterior circumference of the insulating material between the insulating material and the Christmas tree flange;

a connector housing exhibiting an olive shaped cross section with curved corners forming a metal-to-metal seal with the Christmas tree flange, wherein the exterior circumference of the insulating material engages an interior surface of the connector housing; and a retainer engaged with the Christmas tree flange to compress the connector housing and urge the curved corners into engagement with the Christmas tree flange.

13. The apparatus of claim 12, wherein the insulating material fills a circumferential annulus defined between the electrical conductor and the connector housing.

14. The apparatus of claim 12, wherein the retainer is threaded into a longitudinal opening defined in the Christmas tree flange.

15. The apparatus of claim 12, wherein the retainer includes a curved interior surface forming a metal to metal seal with the connector housing.

16. A method of isolating an electrical conductor extending from an electrical device in a Christmas tree, the method comprising;

passing the electrical conductor into a longitudinal opening defined in a Christmas tree flange to define a circumferential annulus around the electrical conductor;

filling the circumferential annulus with an insulating material to form a seal with an exterior of the electrical conductor;

forming a circumferential seal between an exterior of the insulating material and an interior of a connector housing exhibiting an olive shaped cross section, an exterior of the connector housing having curved corners forming a metal-to-metal seal with the Christmas tree flange;

compressing the connector housing with a retainer engaged with the Christmas tree flange to urge the curved corners into engagement with the Christmas tree flange;

coupling the electrical device to the Christmas tree flange; and installing the Christmas tree flange on a wellbore flange such that the electrical device is proximate a flow passageway extending through the wellbore flange.

17. The method of claim 16, further comprising, prior to installing the Christmas tree flange to the wellbore flange, proof testing the seal formed with the exterior of the electrical conductor, the seal formed with the interior of the connector housing and the seal formed with the exterior of the connector housing by applying a test pressure to one side of the Christmas tree flange.

18. The method of claim 16, wherein filling the circumferential annulus with the insulating material includes filling the circumferential annulus with at least one of the group consisting of glass and PEEK material.

19. The method of claim 16, wherein compressing the connector housing with the retainer comprises threading the retainer into the longitudinal opening.

20. The method of claim 16, wherein compressing the connector housing with the retainer comprises forming a metal to metal seal between the connector housing and curved interior surfaces of the retainer.

* * * * *